US010485268B2

(12) United States Patent
Liu

(10) Patent No.: US 10,485,268 B2
(45) **Date of Patent: *Nov. 26, 2019**

(54) ELECTRONIC SMOKING DEVICE

(71) Applicant: SHENZHEN JIANAN TECHNOLOGY CO., LIMITED, Shenzhen, Guangdong (CN)

(72) Inventor: Shuigen Liu, Guangdong (CN)

(73) Assignee: SHENZHEN JIANAN TECHNOLOGY CO., LIMITED, Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/709,409

(22) Filed: Sep. 19, 2017

(65) Prior Publication Data

US 2018/0000165 A1 Jan. 4, 2018

Related U.S. Application Data

(63) Continuation of application No. 13/806,801, filed as application No. PCT/CN2012/082507 on Sep. 29, 2012, now Pat. No. 9,854,840.

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS 4,922,901 A * 5/1990 Brooks ..... A24F 47/006 128/202.27
5,144,962 A * 9/1992 Counts ..... A24F 47/008 128/200.14
2008/0092912 A1 4/2008 Robinson et al.
2011/0036346 A1* 2/2011 Cohen ..... A61M 15/0065 128/200.14
2013/0192617 A1* 8/2013 Thompson ..... A24F 47/008 131/329
2013/0192618 A1* 8/2013 Li ..... A24F 47/008 131/329
2013/0220315 A1* 8/2013 Conley ..... A24F 47/008 128/202.21

FOREIGN PATENT DOCUMENTS

CN 202085723 U 12/2011

OTHER PUBLICATIONS

International Search Report of PCT Patent Application No. PCT/CN2012/082507 dated Jul. 11, 2013.

* cited by examiner

*Primary Examiner* — Eric Yaary

(57) ABSTRACT

The present invention relates to an electronic smoking device, comprising a cell part (1), a cigarette body part (2) and a cigarette holder (3). The cigarette body part (2) comprises a shell (4) and a heating element (7) arranged within the shell (4). The heating element (7) comprises a tobacco container (5) in the shape of tube, and the cigarette body part (2) is provided with a through hole (17) which is connected to the tobacco container (5). The heating element (7) also comprises a heating unit (6); the heating unit (6) is sleeved on the outside of the tobacco container (5). The electronic smoking device of the present invention makes it possible to load and remove the tobacco conveniently, thus facilitating the cleaning of the tobacco container.

4 Claims, 3 Drawing Sheets

ELECTRONIC SMOKING DEVICE

CROSS REFERENCE TO RELATED APPLICATIONS

The present application is a Continuation Application of U.S. patent application Ser. No. 13/806,801 filed on Mar. 30, 2015, which is a national-phase application of PCT Application No. PCT/CN2012/082507 filed on Sep. 29, 2012. All the above are hereby incorporated by reference.

FIELD OF THE INVENTION

The present invention relates to an electronic smoking device, more particularly, to an electronic smoking device with a cigarette body part of hollow structure.

BACKGROUND OF THE INVENTION

At present, in the field of electronic flue-cured tobacco, there are mainly two kinds of products available in the market: one is to provide a heating wire inside a tobacco container, and the other is to heat a tobacco container through combustion of a liquid fuel. However, the tobacco containers in such two kinds of products are both semi-closed cavities which are closed at the bottom and opened at the top. As a result, the volume of the tobacco container is small, in which only some tobacco can be placed. Besides, tobacco rod available in the market can only be loaded by several times after an unraveling, and it is required to dig out the tobacco residue from the top by utilization of a rod-like article like an ear pick after usage, thereby causing extremely inconvenient operation.

SUMMARY OF THE INVENTION

The objective of the present invention is to provide an electronic cigarette for which it is easy to clean a tobacco container, aiming at the drawbacks that the tobacco container is not easy to be cleaned in an electronic smoking device in the prior art.

An electronic smoking device is provided in the present invention, which comprises a cell part, a cigarette body part and a cigarette holder. The cigarette body part comprises a shell and a heating element arranged within the shell; the heating element comprises a tobacco container in the shape of tube, and the cigarette body part is provided with a through hole which is connected to the tobacco container.

The heating element of the electronic smoking device of the present invention also comprises a heating unit which is sleeved on the outside of the tobacco container.

The cigarette body part of the electronic smoking device of the present invention is equipped with a top electrode installed on a back-end of the heating element, and the through hole is arranged on the top electrode.

The electronic smoking device of the present invention also comprises an isolation region; wherein the cigarette holder is connected to one end of the cigarette body part, the cell part is permanently installed on one side of the cigarette body part, and the isolation region is disposed between the cigarette body part and the cell part.

The cigarette holder of the electronic smoking device of the present invention is connected to one end of the cigarette body part, and the cell part is detachably installed on the other end of the cigarette body part.

The electronic smoking device of the present invention also comprises a sealing component which is installed on the other end of the cigarette body part and inserted into the through hole.

The cell part of the electronic smoking device of the present invention comprises a lower electrode which is permanently installed on its front end and in electric connection with a PCB board.

The electronic smoking device of the present invention also comprises a sealing component and the lower electrode has planar ends; wherein one end of the sealing component is inserted into the through hole and its other end presses against the lower electrode.

The electronic smoking device of the present invention also comprises a sealing component and the lower electrode has a cavity; wherein two ends of the sealing component are respectively inserted into the through hole and the cavity.

The electronic smoking device of the present invention also comprises a sealing component and the lower electrode has a cavity; wherein one end of the sealing component is inserted into the cavity and its other end presses against the end of the top electrode.

When implementing the electronic smoking device of the present invention, the following beneficial effects can be achieved: the tobacco container in the cigarette body part of the electronic smoking device is a hollow tubular structure, and the back-end of the cigarette body part is equipped with the through hole so that the tobacco container is connected to the through hole; in this case, the tobacco is easy to be loaded and removed conveniently, thus facilitating the cleaning of the tobacco container.

BRIEF DESCRIPTION OF THE DRAWINGS

The present invention will be further described with reference to the accompanying drawings and embodiments in the following. In the figures.

DETAILED DESCRIPTION OF THE PREFERRED EMBODIMENT

Figure 1:
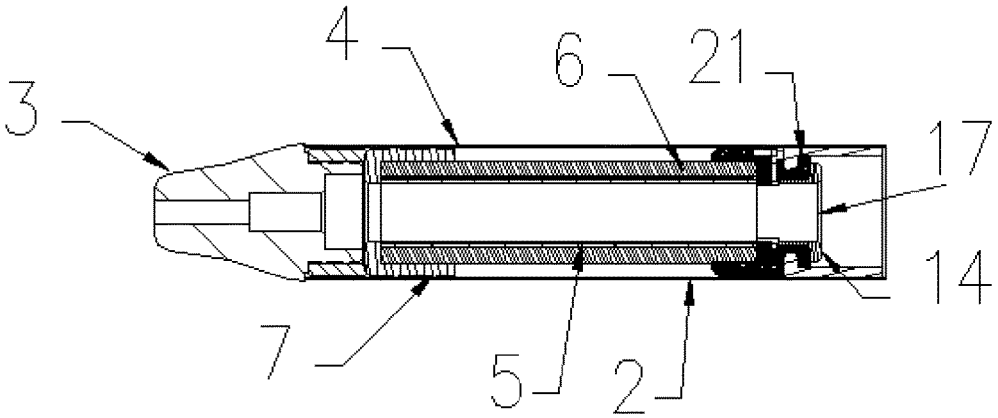
FIG. 1 is a structural sectional view for the cigarette holder and the cigarette body part of the electronic smoking device in the present invention.

To make the objective of the present invention be understood more clearly, now the present invention is described in detail with reference to the accompanying drawings and embodiments. It should be understood that the specific embodiment described herein is only to explain the present invention instead of limiting the present invention.

As shown in FIGS. 1 to 6, an electronic smoking device of the present invention comprises a cell part 1, a cigarette body part 2 and a cigarette holder 3. The cigarette body part 2 comprises a shell 4 and a heating element 7 arranged within the shell 4. The heating element 7 comprises a tobacco container 5 which in the shape of tube and connected to a through hole 17.

The heating element 7 further comprises a heating unit 6 which is sleeved on the outside of the tobacco container 5.

The tobacco is placed within the tobacco container 5.

It is to be understood that the shape of the through hole 17 is not limited specially, i.e. it can be circular, square or other shapes.

Preferably, the shape of the through hole 17 in the present invention is circular, and the inner diameter of the through hole 17 is comparable to that of the tobacco container 5.

Further, the positions where the through hole 17 and tobacco container 5 are arranged are not defined specially. It can be arranged coaxially and can also be arranged eccentrically.

Preferably, the through hole 17 and the tobacco container 5 are set coaxially in the present invention, so that it is convenient to stretch into a cleaning tool from the connecting structure formed by the through hole 17 and the tobacco container 5 to clean the tobacco container 5.

First Embodiment

Figure 3:
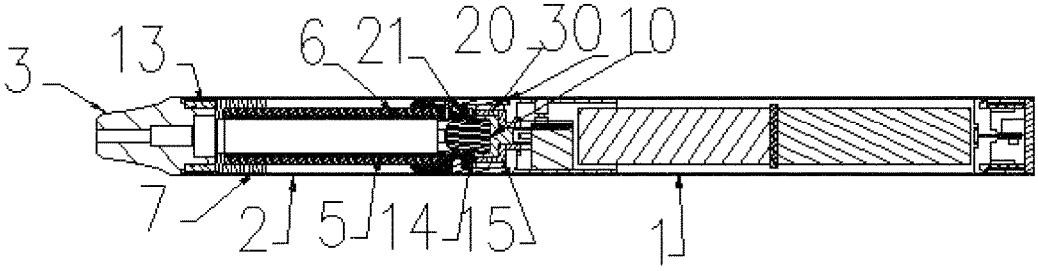
FIG. 3 is an overall structural sectional view for a first implementation in a first embodiment of the electronic smoking device in the present invention.

As shown in FIG. 3, when the cigarette holder 3 is connected with one end of the cigarette body part 2, the cell part 1 is detachably installed on the other end of the cigarette body part 2.

The cigarette body part 2 is further equipped with a top electrode 14 installed on a back-end of the heating element 7, and the through hole 17 is provided on the top electrode 14.

The cross-section of the electronic smoking device is circular.

To improve the safety, the outside of the top electrode 14 is sleeved with an insulation sleeve 21.

Specifically, the insulation sleeve 21 can be consisted of rubber, resin, silica gel and the like.

It is to be understood that the mode to fix the top electrode 14 in the cigarette body part 2 is not defined specially. Specifically, the mode to fix the top electrode 14 in the cigarette body part 2 in the present invention is as follows: an end of the cigarette body part 2 is equipped with a first copper element 30, the insulation sleeve 21 is then clamped inside the first copper element 3, and the top electrode 14 is subsequently clamped inside the insulation sleeve 21 so as to achieve a permanent connection between the top electrode 14 and cigarette body part 2.

The insulation sleeve 21 is in a pressed state at this time.

Figure 2:
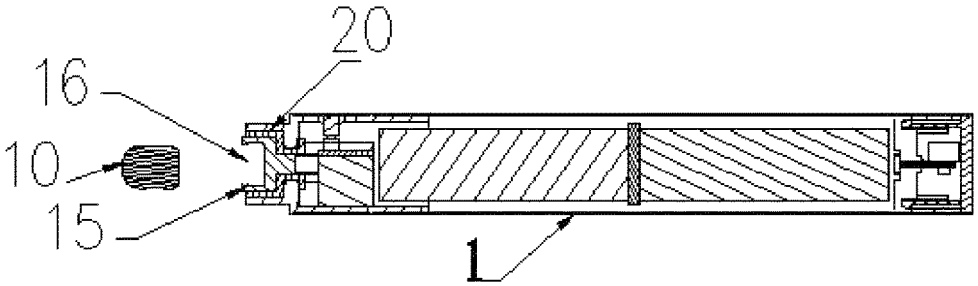
FIG. 2 is an exploded structural sectional view for the cell part and the sealing component of a first implementation in a first embodiment of the electronic smoking device in the present invention.

As shown in FIG. 2, the cell part 1 comprises a lower electrode 15 which is permanently installed on its front end.

To improve the safety, the outside of the lower electrode 15 is sleeved with an insulation sleeve 20.

Specifically, the insulation sleeve 20 can be consisted of rubber, resin, silica gel and the like.

It is to be understood that the mode to fix the lower electrode 15 in the cigarette body part 2 is not defined specially. Specifically, the fixing mode in the present invention is as follows: the insulation sleeve 20 is clamped inside the cell part 1, and the lower electrode 15 is subsequently clamped inside the insulation sleeve 20 so as to fix the lower electrode 15 within the cell part 1.

The insulation sleeve 20 is in a pressed state at this time.

The connection mode between the cell part 1 and cigarette body part 2 has no specific limitation, which can be achieved by interference fit, pin connection, clamp fit, screw-thread fit and the like.

Preferably, the mode of screw-thread fit is employed in the present invention, so that a detachable structure is formed by the cell part 1 and the cigarette body part 2.

Its specific structure is as follows: the end of the cell part 1 is equipped with an external thread, and the first copper element 30 of the cigarette body part 2 is equipped with an inner thread simultaneously; in this way, the outer thread is screwed with the inner thread so as to achieve the connection of the cigarette body part 2 and cell part 1.

When the cell part 1 and the cigarette body part 2 are in the state of connection, the top electrode 14 and the lower electrode 15 contact with each other for ensuring the connection between the electrodes.

The electronic smoking device also comprises a sealing component 10 which is arranged between the cell part 1 and the cigarette body part 2. Herein, the cigarette body part 2 and the cell part 1 are sealed by the sealing component 10.

It is to be understood that the sealing between the cigarette body part 2 and the cell part 1 can be achieved by the following three ways. However, it is not limited to these ways.

Specifically, as shown in FIG. 2 and FIG. 3, the lower electrode 15 has a cavity 16 in a first implementation.

When the cell part 1 is connected with the cigarette body part 2, two ends of the sealing component 10 are respectively inserted into the through hole 17 and the cavity 16.

Since the sealing component 10 is inserted into the through hole 17 and the cavity 16, the sealing between the cell part 1 and the cigarette body part 2 can be achieved.

The connection mode of the sealing component 10 and the through hole 17 is interference fit at this time.

Figure 4:
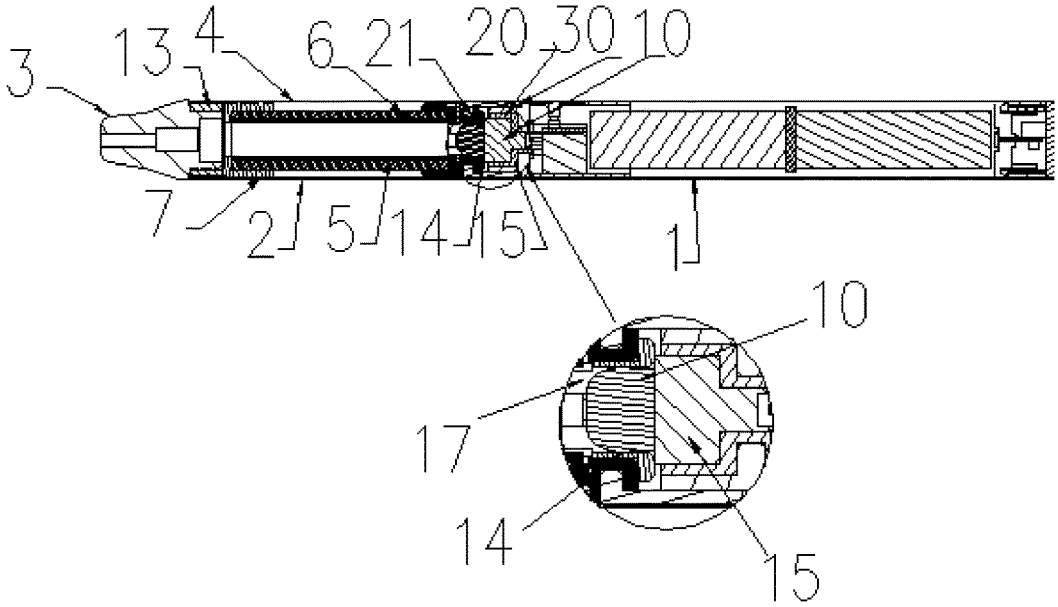
FIG. 4 is an overall structural sectional view for a second implementation in a first embodiment of the electronic smoking device in the present invention.

Further, as shown in FIG. 4, the lower electrode 15 is planar in a second implementation.

One end of the sealing component 10 is inserted into the through hole 17, and its other end presses against the lower electrode 15. Herein, the sealing of the cigarette body part 2 and the cell part 1 is achieved by such structure.

The connection mode of the sealing component 10 and the through hole 17 is interference fit at this time.

Figure 5:
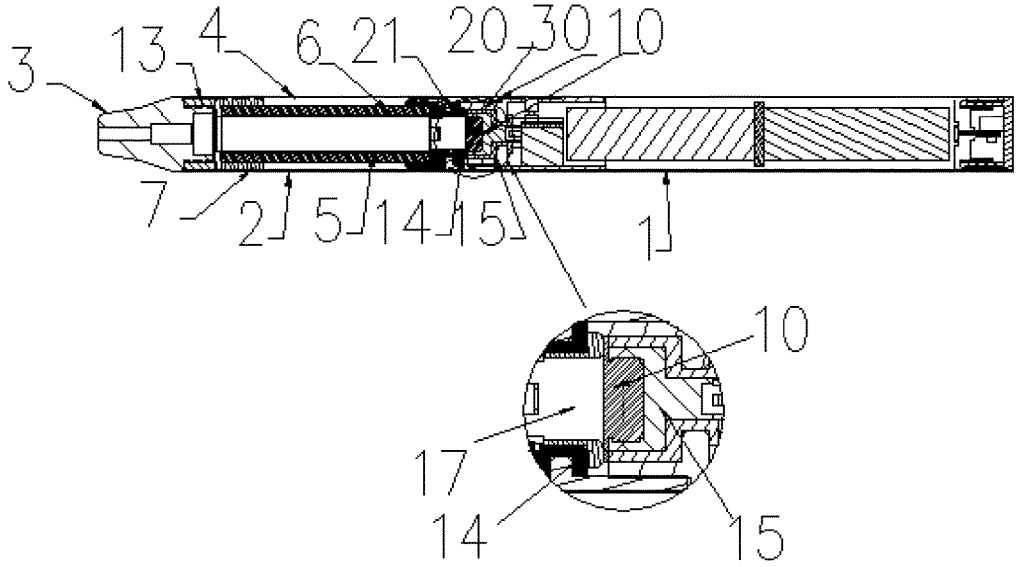
FIG. 5 is an overall structural sectional view for a third implementation in a first embodiment of the electronic smoking device in the present invention.

Further, as shown in FIG. 5, the lower electrode 15 has a cavity 16 in a third implementation.

One end of the sealing component 10 is inserted into the cavity 16, and its other end presses against the end of the top electrode 14. Herein the sealing component can completely block an opening of the through hole 17, in which case the sealing of the cigarette body part 2 and the cell part 1 is achieved by such structure.

The following beneficial effects can be achieved using the seal structure described above.

On one hand, hot air in the cigarette body part 2 does not flow to the cell part 1 during smoking so as to prevent the cell with sensitivity to heat from damage. On the other hand, such structure can prevent the loss of heating heat in the cigarette body part 2 during smoking.

The cigarette holder 3 is installed on one end of the cigarette body part 2.

The cigarette holder 3 and the cigarette body part 2 are detachable with respect to each other.

The cigarette holder 3 is consisted of soft material. For example, it can be consisted by rubber, resin, silica gel and the like.

It is to be understood that the connection mode of the cigarette holder is not defined specially. Specifically, a front end of the cigarette body part 2 is permanently installed with a hollow second copper element 13. The cigarette holder 3 is combined with the cigarette body part 2 by clamping the cigarette holder 3 into the hollow part of the second copper element 13. Wherein, the inner diameter of the cigarette holder 3 is slightly larger than that of the second copper element 13.

In this way, the cigarette holder 3 and the cigarette body part 2 as well as the cell part 1 and the cigarette body part 2 are structures that can be installed detachably, so that when loading the tobacco, the cell part 1 and the cigarette body part 2 can be unscrewed directly to load the tobacco and tobacco rod into the connecting structure formed by the through hole 17 and the tobacco container 5.

In the process of cleaning the tobacco and the tobacco rod, the cigarette holder 3 and the cigarette body part 2 are separated while the cigarette body part 2 and the cell part 1 are unscrewed. Subsequently, a rod-like article which has a size comparable to that of a channel is stretched into the tobacco container 5 to clean the tobacco residue in the tobacco container 5. In this way, it is ensured that no matter the tobacco rod or the hand-cut tobacco can be cleaned out quickly from the tobacco container 5.

When the cigarette holder 3 and the cigarette body part 2 are not detachable, the cigarette holder 3 can be equipped with a through hole for loading or pushing out the tobacco rod and tobacco. When cleaning the tobacco or the tobacco rod, it is only needed to disassemble the cell part 1 and then draw out or remove the tobacco or the tobacco rod by the through hole of the cigarette holder 3, the tobacco container 5 and the through hole 17.

Second Embodiment

Figure 6:
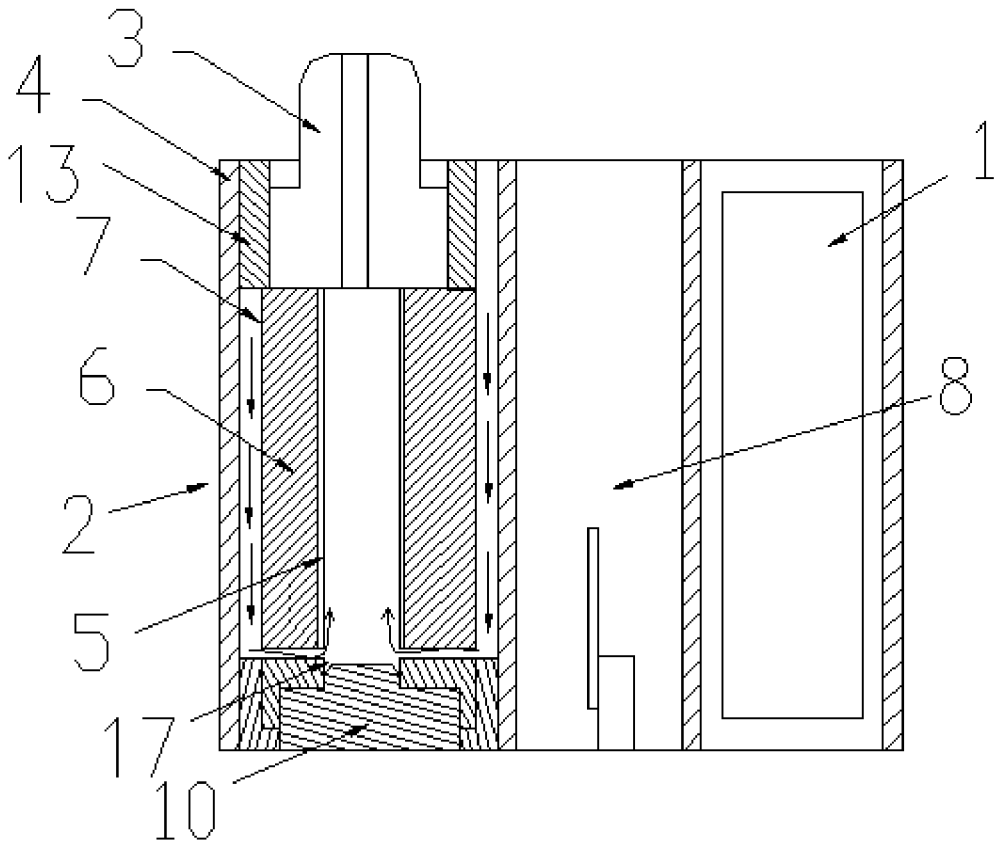
FIG. 6 is an overall structural sectional view for a second embodiment of the electronic smoking device in the present invention.
Figure 7:
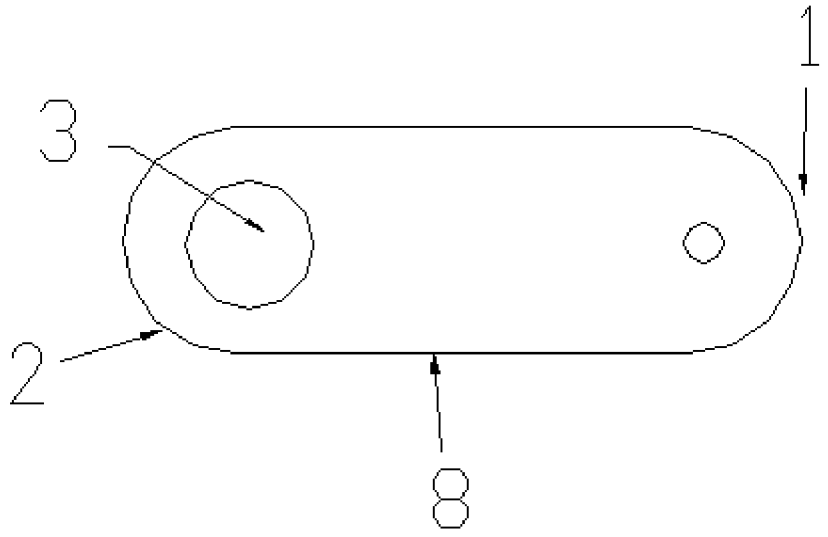
FIG. 7 is a top view for a second embodiment of the electronic smoking device in the present invention.

As shown in FIGS. 6-7, the electronic smoking device also comprises an isolation region 8. Herein, the cigarette holder 3 is connected to one end of the cigarette body part 2, the cell part 1 is permanently installed on one side of the cigarette body part 2, and the isolation region 8 is disposed between the cigarette body part 2 and the cell part 1.

The present embodiment does not comprise the top electrode or the lower electrode. Instead, a PCB board is directly connected with the heating unit through a welding line provided in the isolation region 8.

The isolation region 8 can be provided with some materials such as heat-protective cotton which are configured to isolate the cell part 1 and the cigarette body part 2.

The electronic smoking device of the present embodiment also comprises a sealing component 10. The sealing component 10 is installed on the other end of the cigarette body part 2 and further inserted into the through hole 17.

In this embodiment, since the cell part 1 is permanently installed on one side of the cigarette body part 2 and is isolated by the isolation region 8, the heat generated during smoking does not cause damage to the cell with sensitivity to heat.

The connection mode of the cigarette holder 3 and the cigarette body part 2 in this embodiment is the same as that in the embodiment.

When loading the tobacco, the sealing component 10 is removed directly from the cigarette body part 2. After that, the tobacco and tobacco rod are loaded into the connecting structure formed between the through hole 17 and the tobacco container 5.

In the process of cleaning the tobacco and the tobacco rod, the cigarette holder 3 and the cigarette body part 2 are separated and the sealing component 10 is taken out when the cigarette holder 3 and the cigarette body part are detachable structures, a rod-like article which has a size comparable to that of a channel is stretched into the tobacco container 5 to clean the tobacco residue. In this way, it is ensured that no matter the tobacco rod or the hand-cut tobacco can be cleaned out quickly from the tobacco container 5.

When the cigarette holder 3 and the cigarette body part 2 are not detachable, the cigarette holder 3 can be equipped with a through hole for loading or pushing out the tobacco rod and the tobacco. When cleaning the tobacco or the tobacco rod, it is only needed to disassemble the sealing component 10 from the cigarette body part 2 and then draw out or remove the tobacco or the tobacco rod by the through hole of the cigarette holder 3, the tobacco container 5 and the through hole 17.

While the embodiments of the present invention are described with reference to the accompanying drawings above, the present invention is not limited to the above-mentioned specific implementations. In fact, the above-mentioned specific implementations are intended to be exemplary instead of being limited. In the inspiration of the present invention, those ordinary skills in the art can also make many modifications without breaking away from the subject of the present invention and the protection scope of the claims. All these modifications belong to the protection of the present invention.

The invention claimed is:

1. An electronic smoking device comprising:

a shell;

a partition separating a cigarette body part from a cell part, the cell part arranged parallel to the cigarette body part along a side of the partition;

the cigarette body part having a tubular tobacco container extending parallel to the partition, a heating unit sleeved on an outside wall along the length of the tubular tobacco container, the tubular tobacco container having a first opening at a first end for receiving a tobacco rod and the tubular tobacco container having a second opening at a second end opposite the first end opening to allow air flow through the tubular tobacco container.

2. The electronic smoking device of claim 1 with the heating unit connected to a PCB.

3. The electronic smoking device according to claim 1, further comprising an isolation region (8) and a cigarette holder (3) connected to one end of the cigarette body part (2), the cell part (1) is permanently installed on one side of the cigarette body part (2), and the isolation region (8) is disposed between the cigarette body part (2) and the cell part (1).

4. The electronic smoking device according to claim 1, further comprising a sealing component (10), wherein the sealing component (10) is installed on the other end of the cigarette body part (2) and inserted into the through hole (17).

* * * * *